US005443665A

United States Patent [19]

Sano et al.

[11] Patent Number: 5,443,665

[45] Date of Patent: Aug. 22, 1995

[54] METHOD OF MANUFACTURING A COPPER ELECTRICAL CONDUCTOR, ESPECIALLY FOR TRANSMITTING AUDIO AND VIDEO SIGNALS AND QUALITY CONTROL METHOD FOR SUCH CONDUCTORS

[75] Inventors: Tadanori Sano; Kazuo Sawada; Yoshihiro Nakai; Kenji Miyazaki, all of Osaka, Japan

[73] Assignee: Sumitomo Electric Industries, Ltd., Osaka, Japan

[21] Appl. No.: 201,179

[22] Filed: Feb. 24, 1994

Related U.S. Application Data

[63] Continuation-in-part of Ser. No. 862,818, Apr. 3, 1992, abandoned.

[30] Foreign Application Priority Data

Apr. 5, 1991 [JP] Japan ..... 3-73241
Dec. 6, 1991 [JP] Japan ..... 3-323277

[51] Int. Cl.[6] ..... C21D 8/06

[52] U.S. Cl. ..... 148/509; 148/684; 148/685

[58] Field of Search ..... 148/509, 679, 680, 681, 148/682, 683, 684, 685, 686, 687

[56] References Cited

U.S. PATENT DOCUMENTS 3,663,311 5/1972 Chin et al. ..... 148/684
5,047,922 12/1991 Hiramitsu et al. ..... 148/684
5,147,469 9/1992 Kanzaki et al. ..... 148/684

FOREIGN PATENT DOCUMENTS 62-112763 5/1987 Japan ..... 148/681

OTHER PUBLICATIONS

Metals Handbook, 8th Edition, vol. 11, pp. 407–408, 1976.

*Primary Examiner*—John Sheehan
*Attorney, Agent, or Firm*—W. G. Fasse; W. F. Fasse

[57] ABSTRACT

A method of manufacturing an improved conductor wire, especially for use as wiring in audio/video devices is disclosed. The conductor consists of copper having a high purity of at least 99.9 wt. %. High purity copper starting material is formed as a rod which is then heat treated at a temperature in the range of 400° C. to 700° C. for 1 minute to 24 hours. The heat treated rod is then cold worked with a reduction in area of at least 65%. This method provides an electrical conductor wire which avoids irregularities of electron density and thereby eliminates phase differences in a high frequency signal, such as an audio or video signal, passing through the wire to obtain clear transmission and reproduction of an audio sound or video image. The method of the invention increases the residual resistance ratio of the conductor wire to at least 179 or by at least 20% as compared to a conventional conductor which is not heat treated according to the invention. Finally, in a quality control method, the expected audio and video transmission characteristics of a manufactured conductor wire can be evaluated by determining the residual resistance ratio of the conductor wire.

34 Claims, No Drawings

METHOD OF MANUFACTURING A COPPER ELECTRICAL CONDUCTOR, ESPECIALLY FOR TRANSMITTING AUDIO AND VIDEO SIGNALS AND QUALITY CONTROL METHOD FOR SUCH CONDUCTORS

CROSS-REFERENCE TO RELATED APPLICATION

This application is a Continuation-In-Part of our U.S. application Ser. No. 07/862,818, filed on Apr. 3, 1992, now abandoned, and commonly assigned herewith.

FIELD OF THE INVENTION

The present invention relates to a method of manufacturing a copper electrical conductor to be used especially as wiring in audio and video circuits and, for example, to a method of manufacturing an electrical conductor for use as wiring in stereo sets and in video tape recorder (VTR) sets. The invention further relates to a quality control method for such conductors.

BACKGROUND INFORMATION

If a signal is not transmitted correctly, e.g. if a phase difference is generated in transmitting the signal, in an audio apparatus, such as a stereo system, or in a video apparatus, such as a VTR, then the sound or the image are adversely affected. Specifically, the sound is made unclear and the image is blurred.

Conventionally, an annealed copper wire obtained by cold working tough pitch copper or oxygen free copper and then anneal softening the wire to recrystallize it, a hard drawn copper wire obtained by cold working only, or a wire obtained by plating one of the above types of wire with tin or the like is used as electrical conductor wire for audio/video apparatus.

However, in such a conventional conductor impurity elements or the like included therein disturb the regularity of the electron density in the conductor and thereby cause signals of different phase in the conducted audio or video signal.

SUMMARY OF THE INVENTION

It is an object of the present invention to avoid the above conventional defects and provide a method of manufacturing a conductor that reduces the causes of electron scattering in conventional conductors and that avoids disorders or distortions in the transmission of an audio or video signal to provide a clear sound and a sharp image.

It is a further object of the present invention to provide a method of manufacturing a conductor that exhibits an improved residual resistance ratio (RRR) relative to a conventional conductor and thereby exhibits an improved quality of transmitted or conducted audio or video signals.

It is still another object of the present invention to provide a quality control method for such conductors to be used especially in audio and video devices, whereby it is possible to evaluate the expected audio/video transmission quality of a wire based on the wire's RRR value.

The above objects have been achieved by the present invention which provides a method of manufacturing a conductor, wherein copper having a purity of at least 99.9% by weight is used as the raw starting material and is heat treated at a temperature in the range of 400° C. to 700° C. for a time period in the range of 1 minute to 24 hours at least once during the manufacturing process. The high copper purity of at least 99.9% by weight is maintained throughout the method and in the finished conductor.

According to the present invention the heat treatment is performed after casting a copper rod and prior to cold working the rod. The heat treatment may also be performed after cold working and before the diameter of the wire is finally reduced to the ultimately desired diameter. Even when a cold working step precedes the heat treatment step, another cold working step always follows the heat treatment. Thus, the described heat treatment is always performed prior to a cold working step. According to the present invention, the cold working step after the heat treatment preferably reduces the wire cross-sectional area by at least 65%.

The heat treatment is performed at a temperature in the range of 400° C. to 700° C. according to the present invention, because this allows impurity elements included in the conductor to be precipitated and allows disorder in the electron density to be relieved, so as not cause a phase difference in a high frequency signal current. This makes it possible to obtain a clear sound and a sharp image when using a conductor made according to the invention for conducting an audio/video signal in audio/video devices. If the temperature of the heat treatment is less than 400° C., it is necessary to perform the heat treatment for a long time to obtain a conductor which achieves the desired clear sound and sharp image. Thus, such a low temperature is industrially inadequate and practically uneconomical because it is not efficient. If the temperature is greater than 700° C., impurities will be redissolved. Such a high temperature is industrially disadvantageous because it does not yield the effects intended by the heat treatment.

The heat treatment according to the present invention may be performed either in a continuous system or in a batch system manufacturing process. According to the present invention, the heat treatment is performed after casting a rod and prior to cold working the rod. If the heat treatment is performed after cold working, dislocations introduced by the cold working cause recrystallization and thereby increase grain boundaries during the heat treatment. The conductor obtained under such a condition may generate a phase difference in the current of an audio/video signal. For this reason, it is most preferable to perform the heat treatment prior to all cold working.

It is preferable to perform cold working with a reduction of area of at least 65% after the heat treatment, because in the case of cold working with a reduction of area smaller than that, mechanical properties of the conductor, such as the ultimate tensile strength and the like are deteriorated and any deformation of the conductor may generate a phase difference in the current of an audio/video signal. On the other hand, it has been found that cold working rates that are too high do not achieve additional mechanical benefits, but instead may deteriorate the electrical properties of a conductor heat treated according to the present invention.

Furthermore, it is preferable to use a unidirectional solidification or a single crystal material as the raw material for practicing the present method. In these materials the number of crystal grain boundaries through which current can pass in the conductor is reduced so that the signal phase difference can be reduced and the amount of gas elements, particularly oxygen included in the raw material is so small that formation of compounds having semiconductor like characteristics can be suppressed. According to the present invention, copper having a purity of 99.9 wt. % or more is used as the raw material and maintained with such purity throughout the method, because copper with a purity of less than 99.9 wt. % prevents an audio/video signal from being transmitted correctly.

According to the present invention, the amount of oxygen contained in the conductor after the heat treatment is preferably 40 wt. ppm or less. It is preferable to keep the oxygen content low, because the oxygen exists in the form of $Cu_2O$ in a copper conductor and the $Cu_2O$ has semiconductor-like characteristics and therefore severely disturbs the transmission of a signal when the amount of the oxygen is too large.

In the present invention, the heat treatment carried out before cold working raises the residual resistance ratio (RRR) of the finished conductor wire by 20% or more as compared to a conventional conductor that is not heat treated according to the present invention. It has been found that as the residual resistance ratio is increased, scattering of electrons is reduced, whereby any disorder in the transmission of a signal is also reduced so that it is possible to enhance the quality of an audio/video signal conducted by the wire. According to the present invention, the residual resistance ratio of a heat treated conductor is preferably 200 or more. Generally, copper having a purity of 99.9% exhibits a residual resistance ratio in the range of about 145 to about 200 without treatment as taught herein.

The conductor for use in audio/video equipment according to the present invention can be used as a single strand wire or as a multi-strand wire. Additionally, finish softening can be carried out in the final diameter obtaining step or in the stranding step. It is also possible to plate the surface of a conductor according to the invention with tin or the like, or to coat the conductor with an insulator.

The foregoing and other objects, features, aspects and advantages of the present invention will become more apparent from the following detailed description of the present invention.

DETAILED DESCRIPTION OF PREFERRED EMBODIMENTS AND OF THE BEST MODE OF THE INVENTION

To illustrate a first embodiment, sample conductors Nos. 1 to 14 were prepared as shown in Tables 1A and 1B below. First, rods having a diameter of 12 mm were respectively cast using free oxygen copper having a purity of 99.99% by wt. as the starting raw material. Rods having a polycrystal structure were cast by a horizontal continuous casting method. Other rods having a crystal structure of unidirectional solidification or single crystal were cast in a heated mold using a continuous casting method. Throughout the entire forming of the conductors according to the invention, the original purity of the raw starting material was substantially maintained. No alloying elements or other substances were added to the high purity copper raw material. Thus, the final conductors of the invention also comprise high purity copper.

After casting, a heat treatment was performed under the heat treatment conditions given in Table 1A and Table 1B below. For samples Nos. 1 to 6, rods having a diameter of 12 mm were respectively cast, then heat treated under the heat treatment conditions shown in Tables 1A and 1B and then cold worked to a diameter of 0.78 mm. For sample No. 7, a rod having a diameter of 12 mm was cast, then cold worked to a diameter of 6.2 mm, then heat treated under the heat treatment conditions shown in Tables 1A and 1B and then cold worked again to a diameter of 0.78 mm. Sample No. 8 was heat treated as shown, then cold worked to a diameter of 0.78 mm like samples Nos. 1 to 6, and then finish softening was performed thereon at a temperature of 230° C. for 3 hours. Sample No. 9 was cast as a rod with a 12 mm diameter, then hot worked to a diameter of 8 mm, then heat treated, then cold worked to a diameter of 0.8 mm and finally 21 of such formed rods were used as strands to form a stranded wire. Sample No. 10 was cast as rod with an 8 mm diameter by the horizontal continuous casting method, cold worked to a diameter of 2.0 mm then heat treated at a temperature of 400° C. for 5 hours and finally cold worked again to a diameter of 0.78 mm.

Sample No. 11 for comparison was cast to a diameter of 12 mm by the horizontal continuous casting method, then cold worked once to a diameter of 6.2 mm and then heat treated for 6 hours at a temperature of 850° C., which is out of the literally claimed temperature range herein. After the heat treatment, it was cold drawn again to a diameter of 0.78 mm. Sample No. 12 for comparison was cast to a diameter of 12 mm by the horizontal continuous casting method, then cold worked once to a diameter of 4.6 mm and then heat treated for 2 hours at a temperature of 150° C., which is out of the literally claimed temperature range herein. After the heat treatment, it was cold worked again to a diameter of 0.78 mm.

Sample No. 13 was prepared as a conventional example using tough pitch copper as the raw material for casting a 12 mm diameter rod by the horizontal continuous casting method. The rod was then cold worked to a diameter of 0.78 mm without being heat treated. Sample No. 14 was also prepared as a conventional example by using oxygen-free copper having a purity of 99.9 wt. % for casting a 12 mm diameter rod by the horizontal continuous casting method. The rod was then cold worked to a diameter of 0.78 mm.

TABLE 1A

| | Sample No. | Condition of Heat Treatment | Time of Heat Treatment | Crystal Structure |
|---|---|---|---|---|
| Examples of the Invention | 1 | 480° C. 18 hours | after cast to 12 ϕmm | polycrystal |
| | 2 | 580° C. 5 hours | after cast to 12 ϕmm | polycrystal |
| | 3 | 500° C. 5 hours | after cast to 12 ϕmm | directional solidification |
| | 4 | 580° C. 3 hours | after cast to 12 ϕmm | directional solidification |
| | 5 | 550° C. 10 hours | after cast to 12 ϕmm | single crystal |
| | 6 | 580° C. 1 hour | after cast to 12 ϕmm | single crystal |
| | 7 | 550° C. 30 hours | after cast to 6.2 ϕmm | polycrystal |
| | 8 | 580° C. 4 hours | after cast to 12 ϕmm | polycrystal (soft material) |
| | 9 | 550° C. 10 hours | after hot-worked to 8 ϕmm | polycrystal (strand) |
| | 10 | 400° C. 5 hours | after drawn to 2.0 ϕmm | polycrystal |
| Example for | 11 | 850° C. 6 hours | after drawn to 6.2 ϕmm | polycrystal |

TABLE 1A-continued

| | Sample No. | Condition of Heat Treatment | Time of Heat Treatment | Crystal Structure |
|---|---|---|---|---|
| Comparison | 12 | 150° C. 2 hours | after drawn to 4.6 ϕmm | polycrystal |
| Conventional Example | 13 | (tough pitch copper) | — | polycrystal |
| | 14 | — | — | polycrystal |

TABLE 1B

| Sample No. | Raw Material | Casting (mm) | Heat Treatment | Cold Working (mm) |
|---|---|---|---|---|
| 1 | oxygen free copper | 12 ϕ | 480° C. × 18 H | 0.78 ϕ |
| 2 | oxygen free copper | 12 ϕ | 580° C. × 5 H | 0.78 ϕ |
| 3 | oxygen free copper | 12 ϕ | 500° C. × 5 H | 0.78 ϕ |
| 4 | oxygen free copper | 12 ϕ | 580° C. × 3 H | 0.78 ϕ |
| 5 | oxygen free copper | 12 ϕ | 550° C. × 10 H | 0.78 ϕ |
| 6 | oxygen free copper | 12 ϕ | 580° C. × 1 H | 0.78 ϕ |

| Sample No. | Raw Material | Casting | Cold Working | Heat Treatment | Cold Working |
|---|---|---|---|---|---|
| 7 | oxygen free copper | 12 ϕmm | 6.2 ϕmm | 550° C. × 30 min. | 0.78 ϕmm |

| Sample No. | Raw Material | Casting | Heat Treatment | Cold Working | Heat Treatment (finish softening) |
|---|---|---|---|---|---|
| 8 | oxygen free copper | 12 ϕmm | 580° C. × 30 min. | 0.78 ϕmm | 230° C. × 3 H |

| Sample No. | Raw Material | Casting | Hot Working | Heat Treatment | Cold Working | Stranding |
|---|---|---|---|---|---|---|
| 9 | oxygen free copper | 12 ϕmm | 8 ϕmm | 550° C. × 10 H | 0.8 ϕmm | 21 wires stranded |

| Sample No. | Raw Material | Casting (mm) | Cold Working (mm) | Heat Treatment | Cold Working (mm) |
|---|---|---|---|---|---|
| 10 | oxygen free copper | 8 ϕ | 2.0 ϕ | 400° C. × 5 H | 0.78 ϕ |
| *11 | oxygen free copper | 12 ϕ | 6.2 ϕ | 850° C. × 6 H | 0.78 ϕ |
| *12 | oxygen free copper | 12 ϕ | 4.6 ϕ | 150° C. × 2 H | 0.78 ϕ |

| Sample No. | Raw Material | Casting (mm) | Cold Working (mm) |
|---|---|---|---|
| x13 | tough pitch copper | 12 ϕ | 0.78 ϕ |
| x14 | oxygen free copper | 12 ϕ | 0.78 ϕ |

*Comparative Sample
xConventional Sample

The conductors of samples Nos. 1 to 14 formed as described above, were evaluated as to their audio and video transmission characteristics. To carry out this evaluation, conductors prepared according to samples Nos. 1 to 14 were used as wiring in a stereo and in a VTR. Then the resolution, delicacy, transparency, and density of picture quality and the ability to properly sustain base (low pitched) sound, mid-range (middle pitched) sound, and treble (high pitched) sound were evaluated. The results of the evaluation are shown in Table 2 below. Each result is indicated as a relative value with respect to the conventional sample No. 13 which was allocated the reference value 10.

TABLE 2

| | Sample No. | Relative Signal Quality Audio | Relative Signal Quality Video |
|---|---|---|---|
| Examples of the Invention | 1 | 87 | 89 |
| | 2 | 90 | 91 |
| | 3 | 93 | 95 |
| | 4 | 96 | 94 |
| | 5 | 98 | 96 |
| | 6 | 95 | 94 |
| | 7 | 84 | 82 |
| | 8 | 91 | 90 |
| | 9 | 89 | 89 |
| | 10 | 82 | 81 |
| Examples for Comparison | 11 | 57 | 59 |
| | 12 | 41 | 39 |
| Conventional Examples | 13 | 10 | 10 |
| | 14 | 35 | 32 |

As seen from the results in Table 2, the conductors obtained in accordance with the present invention exhibit superior characteristics in their audio and video signal transmission quality relative to the comparative examples and the conventional examples.

To illustrate a second embodiment, sample conductors Nos. 21 to 33 were prepared as shown in Table 3 below. All the conductors Nos. 21 to 33 were first cast as 8 mm diameter rods. For sample Nos. 27 and 29 of the present invention, rods having a crystal structure of unidirectional solidification were cast by the heated mold type continuous casting type method. For the other samples, rods having a polycrystal structure were cast by the horizontal continuous casting method.

The inventive samples Nos. 21 to 28 were prepared from a raw starting material of so-called oxygen-free copper with an oxygen content of 3 ppm and a purity of 99.9% by weight. Comparative samples Nos. 30 and 31 and conventional sample No. 33 were also prepared from such oxygen free copper. On the other hand, sample No. 29 was prepared from a raw starting material of so-called tough pitch copper having an oxygen content of 190 ppm and a purity of 99.9% by wt. Conventional sample No. 32 was also prepared from such tough pitch copper. Throughout the entire forming of the conductors the original purity of the raw starting material was substantially maintained. No alloying elements or other substances were added to the high purity copper raw material. Thus, the final conductors of the invention also comprise high purity copper.

After casting, heat treatment and cold working as shown in Table 3 below was performed on the samples. For sample No. 21 of the present invention, a cast rod was heat treated at a temperature of 580° C. for 5 hours before cold work drawing to a diameter of 2.6 mm and then heat treating again at a temperature of 220° C. for 3 hours and finally cold working to a 0.8 mm diameter. For sample No. 22 of the present invention, a cast rod was heat treated at a temperature of 600° C. for 3 hours, followed by cold working to a diameter of 0.8 mm. For sample No. 23, a rod was cold drawn to a diameter of 6.8 mm, heat treated at a temperature 500° C. for 5 hours, cold drawn to a diameter of 2.6 mm, then heat treated again at a temperature of 400° C. for one hour, and finally cold worked to a diameter of 0.8 mm.

For sample No. 24 of the present invention, a cast rod was heat treated at a temperature of 580° C. for 5 hours before cold work drawing to a diameter of 2.6 mm, then heat treated again at a temperature of 280° C. for 2 hours, then cold worked to a 0.8 mm diameter and finally, finished softened at a temperature of 230° C. for 3 hours. For sample No. 25 of the present invention, cast rods were heat treated at a temperature of 470° C. for 9 hours, followed by cold working to a 0.2 mm diameter. Then, seven of such cold worked wires were stranded together. After stranding, finish softening was performed thereon at a temperature of 200° C. for 3 hours.

For sample No. 26 of the present invention, a cast rod was heat treated at a temperature of 530° C. for 4 hours, followed by cold working to a 0.8 mm diameter. For sample No. 27 of the present invention, a rod was drawn to a diameter of 6.2 mm, then heat treated at a temperature of 650° C. for 0.5 hours and then cold worked to a 0.8 mm diameter. Finish softening was performed thereon at a temperature of 280° C. for 2 hours. For sample No. 28 of the present invention, a rod was heat treated at 580° C. for 10 hours, whereupon it was cold worked to a 2.6 mm diameter, then heat treated again at 450° C. for 5 hours, then cold worked again to a 1.4 mm diameter and heat treated once again at 400° C. for 2 hours before final cold working to a 0.8 mm diameter. For sample No. 29 of the present invention, a rod was heat treated at a temperature of 600° C. for 5 hours, followed by cold working to a diameter of 2.0 mm and then another heat treating at a temperature of 220° C. for 5 hours and a final cold working to a 0.8 mm diameter.

Samples Nos. 30 and 31 were prepared as comparative samples with a heat treatment outside the literally claimed temperature range. For comparative sample No. 30, a cast rod of oxygen free copper was heat treated at a temperature of 150° C. for 3 hours, followed by cold working. For comparative sample No. 31, a cast rod of oxygen-free copper was heat treated at a temperature of 850° C. for 8 hours, followed by cold working.

Samples Nos. 32 and 33 were prepared as conventional samples with no heat treatment. For conventional sample No. 32, a cast rod of tough pitch copper was cold drawn to a diameter of 0.8 mm. For conventional sample No. 33, a cast rod of oxygen free copper was cold drawn to a diameter of 0.8 mm.

TABLE 3

| Sample No. | Raw Material | Casting | Heat Treatment | Cold Working | Heat Treatment | Cold Working | |
|---|---|---|---|---|---|---|---|
| 21 | oxygen free copper | 8 ϕmm | 580° C. × 5 H | 2.6 ϕmm | 220° C. × 3 H | 0.8 ϕmm | |
| Sample No. | Raw Material | Casting | Heat Treatment | Cold Working | | | |
| 22 | oxygen free copper | 8 ϕmm | 600° C. × 3 H | 0.8 ϕmm | | | |
| Sample No. | Raw Material | Casting | Cold Working | Heat Treat-ment | Cold working | Heat Treat-ment | Cold Working |
| 23 | oxygen free copper | 8 ϕmm | 6.8 ϕmm | 500° C. × 5 H | 2.6 ϕmm | 400° C. × 1 H | 0.8 ϕmm |
| Sample No. | Raw Material | Casting | Heat Treatment | Cold Working | Heat Treat-ment | Cold Work-ing | Heat Treat-ment |
| 24 | oxygen free copper | 8 ϕmm | 580° C. × 5 H | 2.6 ϕmm | 280° C. × 2 H | 0.8 ϕ mm | 230° C. × 3 H |
| Sample No. | Raw Material | Casting | Heat Treatment | Cold Working | Stranding | Heat Treatment | |
| 25 | oxygen free | 8 ϕmm | 470° C. × 9 H | 0.2 ϕmm | 7 wires stranded | 200° C. × 3 H | |

TABLE 3-continued

| | | | | | | | | |
|---|---|---|---|---|---|---|---|---|
| | copper | | | | | | | |
| Sample No. | Raw Material | Casting | Heat Treatment | Cold Working | | | | |
| 26 | oxygen free copper | 8 ϕmm | 530° C. × 4 H | 0.8 ϕmm | | | | |
| Sample No. | Raw Material | Casting | Cold Working | Heat Treatment | Cold Working | Heat Treatment | | |
| 27 | oxygen free copper | 8 ϕmm 30 min. | 6.2 ϕmm | 650° C. × | 0.8 ϕmm | 280° C. × 2 H | | |
| Sample No. | Raw Material | Casting | Heat Treatment | Cold Working | Heat Treatment | Cold Work Treating | Heat Workment | Cold ing |
| 28 | oxygen free copper | 8 ϕmm 10 H | 580° C. × | 2.6cmm 5 H | 450° C. × | 1.4 ϕmm 2 H | 400° C. × | 0.8 ϕmm |
| Sample No. | Raw Material | Casting | Heat Treatment | Cold Working | Heat Treatment | Cold working | | |
| 29 | tough pitch copper | 8 ϕmm | 600° C. × 5 H | 2.0 ϕmm | 220° C. × 5 H | 0.8 ϕmm | | |
| Sample No. | Raw Material | Casting | Heat Treatment | Cold Working | | | | |
| *30 | oxygen free copper | 8 ϕmm | 150° C. × 3 H | 0.8 ϕmm | | | | |
| Sample No. | Raw Material | Casting | Heat Treatment | Cold Working | | | | |
| *31 | oxygen free copper | 8 ϕmm | 850° C. × 8 H | 0.8 ϕmm | | | | |
| Sample No. | Raw Material | Casting | Cold Working | | | | | |
| x32 | tough pitch copper | 8 ϕmm | 0.8 ϕmm | | | | | |
| Sample No. | Raw Material | Casting | Cold working | | | | | |
| x33 | oxygen free copper | 8 ϕmm | 0.8 ϕmm | | | | | |

*Comparative Sample
xConventional Sample

In order to carry out a comparative evaluation, the conductors formed as described above were all uniformly heat treated at a temperature of 300° C. for 2 hours for removing dislocations and the like. Then the resistance of each sample was measured at a room temperature of 298K and at a liquid helium temperature of 4.2K using a four terminal method to determine a resistivity of each conductor material at 298K (resistivity R298K) and at 4.2K (resistivity R4.2K). Then the residual resistance ratio (RRR=R298K/R4.2K) was calculated for each sample as shown in Table 4 below.

Determining RRR for each sample in effect allows the resistance of different samples to be normalized to disregard influences such as sample length and diameter, impurity type and content, dislocations of crystal grain boundaries or other influences of the working steps, etc. The resistivity includes a thermal component, a physical component, and a chemical component. The resistivity at low temperatures (i.e. R4.2K) essentially avoids the thermal resistive component so that RRR=R298K/R4.2K evaluates the resistivity caused by factors other than the thermal oscillation of lattices. That is to say, a low resistivity caused by factors other than thermal factors will result in a high RRR value. Thus, it is believed that an increased RRR value will result in improved signal transmission quality because resistive factors other than the unavoidable thermal factors (for room temperature use of the conductors) have been reduced.

The conductors of samples Nos. 21 to 33 were used as wiring in a stereo and in a VTR to evaluate the audio and video transmission characteristics of the conductors. The resolution, delicacy, transparency, and density of picture quality and the sustaining of base (low pitched) sound, mid-range (middle pitched) sound, and treble (high pitched) sound were estimated as relative values with respect to a reference value of 10 allocated to conventional sample No. 32. The results of the audio and video evaluation, as well as the determined RRR values and percentage increase in RRR for each conductor are shown in Table 4 below. The percentage increase in RRR is calculated relative to the conventional sample of the same starting material and with no heat treatment.

TABLE 4

| Sample | | Residual Resistance Ratio | Percent Increase in Residual Resistance Ratio | Relative Signal Quality Audio | Relative Signal Quality Video |
|---|---|---|---|---|---|
| Examples of the Invention | No. 21 | 301 | 64.5 | 87 | 89 |
| | No. 22 | 285 | 55.7 | 85 | 87 |
| | No. 23 | 319 | 74.3 | 91 | 93 |
| | No. 24 | 312 | 70.5 | 88 | 92 |
| | No. 25 | 307 | 67.8 | 91 | 92 |
| | No. 26 | 331 | 80.9 | 95 | 96 |
| | No. 27 | 353 | 92.9 | 99 | 98 |
| | No. 28 | 377 | 106.0 | 100 | 100 |
| | No. 29 | 179 | 23.4 | 36 | 35 |
| Examples for Comparison | No. 30 | 192 | 4.9 | 47 | 44 |
| | No. 31 | 211 | 15.3 | 58 | 60 |
| Conventional Examples | No. 32 | 145 | 0 | 10 | 10 |
| | No. 33 | 183 | 0 | 40 | 38 |

As seen from the results in Table 4, the conductors according to the present invention exhibit superior characteristics in the transmission of audio and video signals compared to the conductors of comparative samples Nos. 30 and 31 and of conventional samples Nos. 32 and 33. As described above, according to the present invention, it is possible to obtain an improved audio and video signal transmission by reducing the scatter of electrons and reducing disorders in the conductor wires used for the transmission of such signals. Thus, it has been found that conductors produced according to the invention exhibit an increased RRR value as compared to conventional conductors, and that such an increased RRR value corresponds to improved audio and video signal transmission quality.

In addition, because the present invention does not need to perform high purification by a particular process, such as a zone melting process, it is possible to manufacture a satisfactory conductor at relatively low cost and by an industrially advantageous and economical method. A sufficient purity of the conductor is assured simply by starting with a high purity raw material and avoiding the addition of any impurities during the method of the invention.

As a further aspect of the present invention, it is possible to carry out the quality control of manufactured conductor wires, especially for use in audio and video devices. As shown above, it has been found that conductor wires with an RRR value preferably above 200 and more preferably above 280 will exhibit advantageous audio and video signal transmission characteristics. Alternatively, advantageous audio and video transmission quality is exhibited by wire conductors having an RRR value preferably at least 20% greater, and more preferably at least 50% greater, than the RRR value of a conductor of similar material, but without heat treatment according to the invention.

Thus, to carry out a quality control of manufactured wire conductors according to the invention, the resistance of a sample of a respective wire must be measured at about room temperature, for example at 298K, and at a sufficiently cold temperature to make thermal resistive effects negligibly small, for example at 4.2K. Then, the resistivity of the sample is determined at each of these two temperatures and RRR is calculated as described above. Conductors are then accepted or rejected, depending on whether the respective sample's RRR value exceeds a desired threshold RRR value (e.g. 200) or an improvement threshold (e.g. 20%) relative to a standard wire RRR value as described above.

Although the invention has been described with reference to specific example embodiments, it will be appreciated that it is intended to cover all modifications and equivalents within the scope of the appended claims.

What we claim is:

1. A method of manufacturing an electrical conductor wire having an improved transmission quality for audio and video signals to be conducted by said wire, said method comprising the following steps:

(a) casting from molten copper a rod of high purity copper having a purity of at least 99.9 wt. % copper;

(b) maintaining said purity of at least 99.9 wt. % throughout all steps of said method;

(c) performing a first heat treating of said rod of high purity copper at a temperature within the range of 400° C. to 700° C. for a time within the range of 1 minute to 24 hours, expressly excluding cold working steps between said casting step and said first heat treating step;

(d) performing a second heat treating at a temperature within the range of about 200° C. to about 400° C. for a time within the range of about 1 hour to about 5 hours; and (e) cold working said heat treated rod to form said electrical conductor wire;

wherein after said heat treating steps and said cold working step, a residual resistance ratio in said electrical conductor wire is at least 20% higher than a conventional residual resistance ratio of a high purity copper conductor wire that is not heat treated according to said heat treating steps.

2. The method of claim 1, wherein said residual resistance ratio is the resistivity of said conductor wire at a temperature of about 298K divided by the resistivity of said conductor wire at a temperature of about 4.2K.

3. The method of claim 1, wherein said achieved residual resistance ratio is at least 200.

4. The method of claim 1, wherein said achieved residual resistance ratio is at least 280.

5. The method of claim 1, wherein said achieved residual resistance ratio is at least 179.

6. The method of claim 1, wherein said achieved residual resistance ratio is at least 50% higher than said conventional residual resistance ratio.

7. The method of claim 1, further comprising a step of measuring said residual resistance ratio of said electrical conductor wire.

8. The method of claim 7, further comprising a step of rejecting said electrical conductor wire if said residual resistance ratio determined in said measuring step is below a threshold value.

9. The method of claim 1, expressly excluding cold working steps between said first heat treating step and said second heat treating step.

10. The method of claim 9, further expressly excluding hot working steps between said casting step and said first heat treating step.

11. The method of claim 1, wherein said cold working step is performed to reduce a cross-sectional area of said heat treated rod by at least 65% to form said electrical conductor wire.

12. The method of claim 1, wherein said first heat treating step is performed at a temperature within the range of 530° C. to 650° C. for a time within the range of 1 to 10 hours.

13. The method of claim 1, wherein an oxygen content of said high purity copper is not more than 40 wt. ppm and said purity maintaining of step (b) is performed to maintain said oxygen content not more than 40 wt.ppm in said electrical conductor wire.

14. The method of claim 1, wherein said first heat treating step is performed at a temperature within the range of about 450° C. to about 650° C. for a time within the range of about ½ hour to about 5 hours.

15. The method of claim 1, further comprising a step of applying an insulating coating onto said electrical conductor wire.

16. A method of manufacturing an electrical conductor wire having an improved transmission quality for audio and video signals to be conducted by said wire, said method comprising the following steps:

(a) forming a rod of high purity copper having a purity of at least 99.9 wt. % copper;

(b) maintaining said purity of at least 99.9 wt. % throughout all steps of said method;

(c) heat treating said rod of high purity copper after said forming step without any intervening cold working step, wherein said heat treating is performed at a temperature within the range of 400° C. to 700° C. for a time within the range of 1 minute to 24 hours to form a heat treated rod; and (d) cold working said heat treated rod to form said electrical conductor wire;

wherein said heat treating step and said cold working step are carried our for achieving a residual resistance ratio in said electrical conductor wire being at least 20% higher than a conventional residual resistance ratio of a high purity copper conductor wire that is not heat treated according to said heat treating step.

17. The method of claim 16, wherein said achieved residual resistance ratio is at least 179.

18. A method of evaluating the quality of a 99.9 wt % pure copper electrical conductor wire to be used for conducting audio/video signals, said method comprising the following steps:

(a) measuring a cold resistivity of a sample of said wire at a first temperature;

(b) measuring a room temperature resistivity of said sample at a second temperature about room temperature;

(c) determining a residual resistance ratio as said room temperature resistivity divided by said cold resistivity; and (d) rejecting said electrical conductor wire if said residual resistance ratio is below an acceptable threshold value.

19. The method of claim 18, wherein said first temperature is about 4.2K and said second temperature is about 298K.

20. The method of claim 18, wherein said acceptable threshold value is a value at least 200.

21. The method of claim 18, wherein said acceptable threshold value is a value at least 20% higher than a conventional residual resistance ratio of a conventional high purity conductor wire.

22. The method of claim 16, further comprising a second heat treating step performed before said cold working step, wherein said first heat treating step (c) is performed at a temperature within the range of about 450° C. to about 650° C. for a time within the range of about ½ hour to about 5 hours and said second heat treating step is performed at a temperature within the range of about 200° C. to about 400° C. for a time within the range of about 1 hour to about 5 hours.

23. The method of claim 22, expressly excluding cold working steps between said first and second heat treating steps.

24. The method of claim 16, expressly excluding hot working steps between said forming step and said heat treating step.

25. The method of claim 16, wherein said achieved residual resistance ratio is at least 200.

26. A method of manufacturing an electrical conductor wire having an improved transmission quality for audio and video signals to be conducted by said wire, said method comprising the following steps:

(a) casting from molten copper a rod of high purity copper having a purity of at least 99.9 wt. % copper;

(b) maintaining said purity of at least 99.9 wt. % throughout all steps of said method;

(c) heat treating said rod of high purity copper at a temperature within the range of 400° C. to 700° C. for a time within the range of 1 minute to 24 hours to form a heat treated rod; and (d) cold working said heat treated rod to form said electrical conductor wire;

wherein said heat treating step and said cold working step are carried out for achieving a residual resistance ratio in said electrical conductor wire being at least 20% higher than a conventional residual resistance ratio of a high purity copper conductor wire that is not heat treated according to said heat treating step.

27. The method of claim 1, further comprising a cold working step between said first heat treating step and said second heat treating step.

28. The method of claim 16, further comprising a second heat treating step performed at a temperature within the range of about 200° C. to about 400° C.

29. The method of claim 28, further comprising a cold working step between said first heat treating step and said second heat treating step.

30. The method of claim 16, wherein said achieved residual resistance ratio is at least 280.

31. The method of claim 16, wherein said achieved residual resistance ratio is at least 50% higher than said conventional residual resistance ratio.

32. The method of claim 16, wherein said heat treating step is performed at a temperature within the range of 530° C. to 650° C. for a time within the range of 1 to 10 hours.

33. The method of claim 26, further comprising a second heat treating step performed at a temperature within the range of about 200° C. to about 400° C.

34. The method of claim 33, further comprising a cold working step between said first heat treating step and said second heat treating step.

* * * * *

UNITED STATES PATENT AND TRADEMARK OFFICE

CERTIFICATE OF CORRECTION

PATENT NO. : 5,443,665

DATED : Aug.22, 1995

INVENTOR(S) : Sano et al.

It is certified that error appears in the above-identified patent and that said Letters Patent is hereby corrected as shown below:

Title Page:

In [56] References Cited, U.S. PATENT DOCUMENTS, replace "5,047,922" by --5,074,922--.

Col. 4, in TABLE 1A, under the heading "Time of Heat Treatment", in Sample No. 7, replace "cast" by --drawn--.

Col. 5, in TABLE 1B, under the heading "Heat Treatment" in Sample No. 8, replace "580° C. X 30 min." by --580°C x 4H--.

Cols. 9 and 10, in TABLE 3-continued, Under the heading "Casting" in Sample No. 27, delete "30 min.";

Under the heading "Heat Treatment" (1st. oc.) in Sample No. 27, insert --30 min.--.

Under the heading "Casting" in Sample 28, delete "10 H";
Under the heading "Heat Treatment" (1st. oc.) insert --10 H--;
Under the heading "Cold Working" (1st. oc.) replace "2.6ccm 5 H" by --2.6 omm--;
Under the heading "Heat Treatment (2nd. oc.) after "°C X" insert --5 H--;
Replace the heading" Cold Work Treat- ing" by --Cold Working-- and under this heading, delete "2H";

UNITED STATES PATENT AND TRADEMARK OFFICE

CERTIFICATE OF CORRECTION

PATENT NO. : 5,443,665

DATED : Aug. 22, 1995

INVENTOR(S) : Sano et al.

It is certified that error appears in the above-identified patent and that said Letters Patent is hereby corrected as shown below:

In Sample 28, replace the heading "Heat Work- ment" by --Heat Treatment--, and under this heading replace "400°C. X" by --400°C X 2 H--;

replace the heading "Cold ing" by --Cold Working--.

In col. 13, line 32, replace "our" by --out--.

Signed and Sealed this

Fifth Day of December, 1995

*Attest:*

*Attesting Officer*

Bruce Lehman

BRUCE LEHMAN

*Commissioner of Patents and Trademarks*